United States Patent [19]

Caulfield et al.

[11] Patent Number: 4,919,454

[45] Date of Patent: Apr. 24, 1990

[54] TIEBACK CONNECTOR WITH PROTECTIVE LANDING SLEEVE

[75] Inventors: J. Keith Caulfield; B. Lee Danner; Lionel J. Milberger, all of Houston, Tex.

[73] Assignee: Vetco Gray Inc., Houston, Tex.

[21] Appl. No.: 311,084

[22] Filed: Feb. 14, 1989

[51] Int. Cl.[5] ..... F16L 27/06

[52] U.S. Cl. ..... 285/18; 166/338; 166/382; 166/55.7; 285/24; 285/141; 405/195; 405/169

[58] Field of Search ..... 405/195, 169, 170, 171; 285/3, 18, 27, 139, 140, 24, 141, 142, 143, 315; 166/348, 338, 339, 382, 360, 341, 368, 335, 55, 55.1, 55.7

[56] References Cited

U.S. PATENT DOCUMENTS

| | | | |
|---|---|---|---|
| 4,046,405 | 9/1977 | Bonds | 285/3 |
| 4,289,206 | 9/1981 | Kirkland | 285/140 X |
| 4,295,665 | 10/1981 | Pierce | 285/141 X |
| 4,307,902 | 12/1981 | Schnatzmeyer | 285/3 |
| 4,353,420 | 10/1982 | Miller | 166/382 |
| 4,422,507 | 12/1983 | Reimert | 166/348 |
| 4,456,070 | 6/1984 | Watkins | 166/345 |
| 4,477,105 | 10/1984 | Wittman et al. | 285/18 |
| 4,595,063 | 6/1986 | Jennings et al. | 166/217 X |
| 4,742,874 | 5/1988 | Gullion | 285/141 X |
| 4,819,967 | 4/1989 | Calder et al. | 285/315 X |

*Primary Examiner*—Dennis L. Taylor
*Attorney, Agent, or Firm*—James E. Bradley

[57] ABSTRACT

A tieback connector will tieback an upper string of casing to a lower string of casing at the wellhead of a subsea well. The tieback connector has a lower tieback member than latches into the wellhead. A lower landing shoulder is located in the wellhead. When reconnecting, an upper tieback member is lowered with the upper casing string. A landing sleeve carried by the upper tieback member has an upper landing shoulder for engaging the lower landing shoulder. The upper tieback member will move between an upper and a lower position relative to the landing sleeve. The landing sleeve first contacts the lower landing shoulder before the upper tieback member threads contact the lower tieback member threads. Then, the upper tieback member will move down to engage the threads.

8 Claims, 3 Drawing Sheets

TIEBACK CONNECTOR WITH PROTECTIVE LANDING SLEEVE

BACKGROUND OF THE INVENTION

1. Field of the Invention

This invention relates in general to offshore oilfield equipment, and in particular to a tieback connector for connecting well casing located in the well to a string of casing extending down from the surface to a subsea wellhead.

2. Description of the Prior Art

This invention deals with subsea wells having a wellhead located at the sea floor. In these types of wells, the well is drilled to a first depth, then large diameter casing is installed and cemented in place. Then the well will be drilled to a second depth, and a second string of casing will be cemented in place. The diameter of the second string may be 9⅝ inches. Both strings of casing will be supported at the wellhead by means of casing hangers. A riser will extend from the wellhead to the surface vessel.

In one technique, a third string of casing, which might be 7 inches in diameter, is lowered into the well, and hung off at the lower end of the second string. The 7 inch string of casing will extend completely to the surface vessel, which would likely be a tension leg platform. A tieback connector will be located in the 7 inch casing string and positioned at the wellhead. The tieback connector allows the 7 inch casing to be disconnected at the wellhead, if necessary. When disconnected, the 7 inch casing above the wellhead can be retrieved to the surface vessel. Later, a new connection can be made.

Improvements to this system are desirable. One improvement would be to provide protection means so as to avoid damaging any latching profiles for the tieback connector while drilling the well for the 7 inch casing. Another desirable feature would be to have protection means to assure that the tieback threads are not damaged when lowering the upper portion of the tieback connector on reconnection. Another desirable feature would be to provide means for releasing the upper portion of the tieback connector in case the tieback threads cannot be loosened. It would also be desirable to have a second set of tieback threads for use in the event damage happened to the primary set, or if they were removed during an emergency releasing procedure.

SUMMARY OF THE INVENTION

The tieback connector of this invention has upper and lower tieback members. The lower tieback member latches into the wellhead, preferably into a lockdown member that lands in the 9⅝ inch casing hanger. The lower tieback member has a primary tieback thread and a secondary tieback thread spaced axially from the primary tieback thread. Also, the lower tieback assembly has a lower landing shoulder.

The upper tieback member has mating tieback threads for engaging the primary tieback threads of the lower member. A landing sleeve, carried by the upper tieback member, has a landing shoulder which engages the landing shoulder of the lower tieback member assembly. This landing sleeve can move up and down relative to the upper tieback member. It is positioned so that it contacts the landing shoulder first, before the tieback threads contact each other. Rotation of the upper tieback member then moves the upper tieback member down into engagement with the tieback threads.

An area located between the primary and secondary tieback threads can be cut by a casing cutter for emergency release. Subsequently, the secondary tieback threads serve to connect the upper tieback member.

DESCRIPTION OF THE PREFERRED EMBODIMENT

Figure 1A:
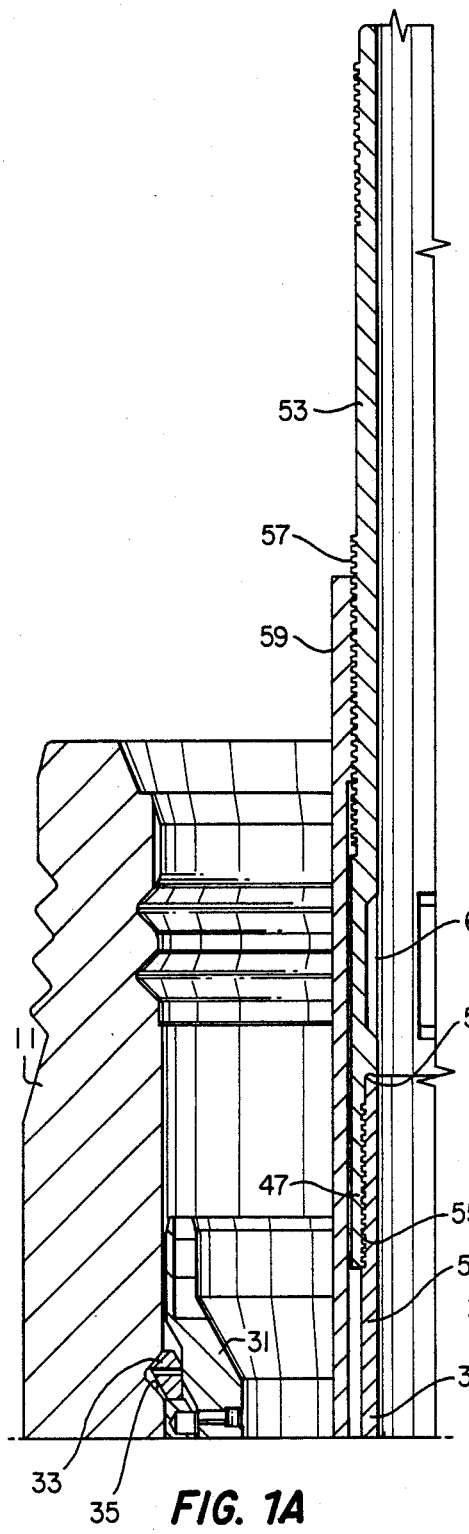
FIGS. 1A–1C are quarter sectional views of a tieback connector constructed in accordance with this invention, and shown in the fully connected position.
Figure 1B:
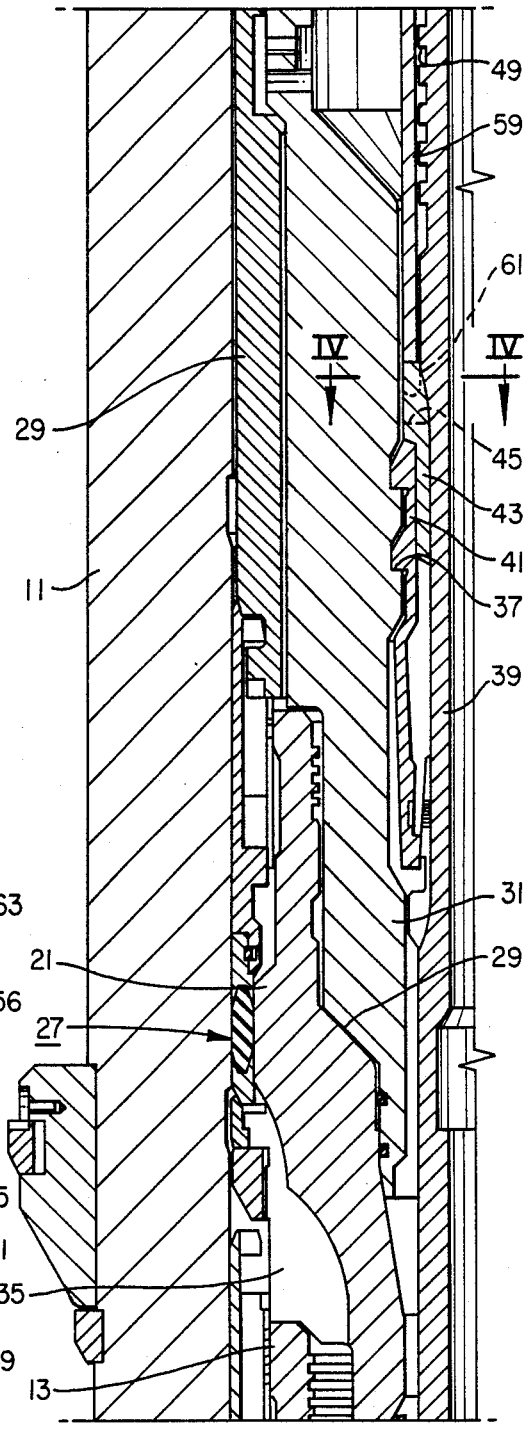
Figure 1C:
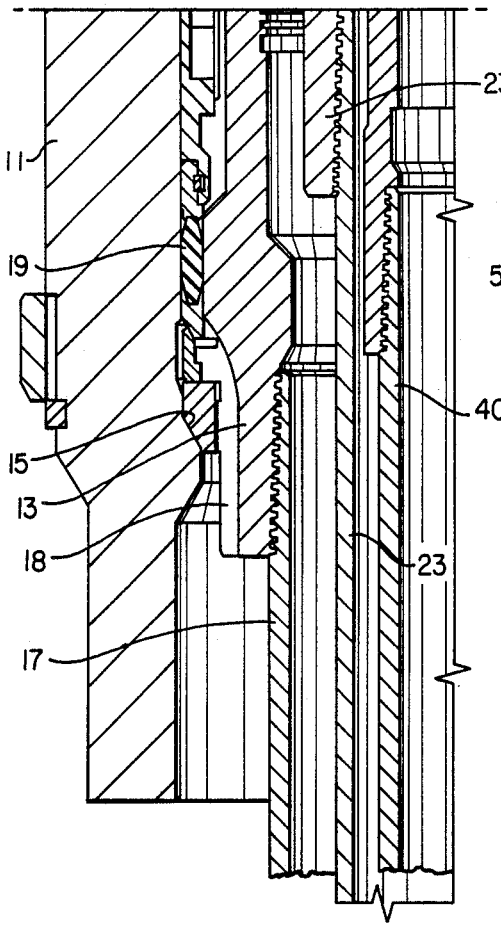

Referring to FIGS. 1A–1C, a wellhead housing 11 will be located in the subsea floor. A lower casing hanger 13 will be supported in the wellhead housing 11. The lower casing hanger 13 lands on a load shoulder 15 located in the bore of the wellhead housing 11. The lower casing hanger 13 will be connected to a string of casing 17. In the embodiment shown, the casing 17 will be 13⅜ inch diameter casing. Passages 18 are located on the sides of the lower casing hanger 13 for allowing cement returns. A conventional packoff assembly 19 will seal between the lower casing hanger 13 and the bore of the wellhead housing 11.

An upper casing hanger 21 will land on top of the lower casing hanger 13. The upper casing hanger 21 is connected to a string of casing 23. Casing 23 in the preferred embodiment is 9⅝ inch diameter casing. Return passages 25 (FIG. 1B) provide for cement returns. After cementing, a packoff 27 is installed. The packoff 27 is retained in place by a drive nut 28.

After the well has been drilled through the 9⅝ inch casing 23, a lockdown member 31 is lowered in place. The lockdown member 31, shown in FIG. 1B, seats on a conical bore 29 located within the interior of the upper casing hanger 21. The lockdown member 31 extends up to a point above the drive nut 28. A split locking ring 33 snaps out into engagement with a recess 35 located in the bore of the wellhead housing 11. This secures the lockdown member 31 in place. The lockdown member 31 has a grooved profile 37 located in its interior. Profile 37 comprises two saw-toothed shaped grooves. Each of the grooves of the profile 37 have an upper flank which inclines downward and inward.

A lower tieback member 39 lands in the lockdown member 31. The lower tieback member 39 is connected to a string of 7 inch diameter casing 40. The casing 40 extends into the well and serves as a production casing. A collet 41 carried by the lower tieback member 39 serves for latching the lower tieback member 39 to the lockdown member 31. Collet 41 is biased outward to snap into the grooved profile 37 of the lockdown member 31. As collet 41 snaps into place, continued downward movement results in a wedge member 43 sliding inward of the collet 41 to serve as a backup. Wedge member 43 is part of the assembly of the lower tieback member 39 and is rigidly mounted to the lower tieback member 39.

Figure 4:
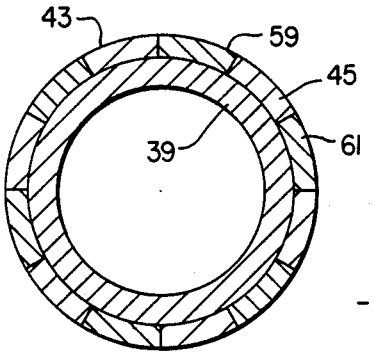
FIG. 4 is a sectional view of the tieback connector of FIGS. 1A–1C, taken along the line IV—IV of FIG. 1B.

A plurality of castellations 45, shown also in FIG. 4, are formed on the upper end of the wedge member 43. Castellations 45 comprise large, square cut teeth. The castellations 45 provide a lower landing shoulder that faces upward.

The lower tieback member 39 also has a set of primary tieback threads 47. As shown in Figure 1A, the tieback threads 47 are preferably of a multistart type. A set of external secondary tieback threads 49 are spaced axially below the primary tieback threads 47 a selected distance. The area 51 located between the threads 47, 49 can be cut for emergency release, as will be described subsequently. Secondary tieback threads 49 are coarser than the primary tieback threads 47, and are preferably a single start square cut type of thread.

The tieback connector also includes an upper tieback member 53. The upper tieback member 53 is secured to 7 inch diameter casing (not shown) that extends to the surface. Upper tieback member 53 has a lower threaded end 55 which has threads for mating with the primary tieback threads 47. A shoulder 56 located in the interior of the upper tieback member 53 will contact the upper end of the lower tieback member 39 to provide metal sealing when the threads 47, 55 are made up.

A set of exterior threads 57 formed on the upper tieback member 53 carry a landing sleeve 59. Landing sleeve 59 has a lower end or shoulder which contains castellations 61. The castellations 61 are adapted to mate and interlock with the castellations 45. A number of milled slots 63 in the interior of upper tieback member 53 allow the upper tieback member 53 to be rotated relative to the landing sleeve 59. The threads 57 are long enough to allow the upper tieback member 53 to be carried in an upper position relative to the landing sleeve 59, shown in FIGS. 2A and 3A. In the upper position, the threads 55 of the upper tieback member 53 will be spaced above the threads 47 of the lower tieback member 39 when the sleeve castellations 61 contact the castellations 45. Rotation of the upper tieback member 53 relative to the landing sleeve 59 then screws the upper tieback member 53 downward so that the threads 47 and 55 will engage each other.

In operation, after the hole for the 7 inch diameter casing 40 has been drilled, the lockdown member 31 will be lowered in place and latched by the ring 33 (FIG. 1A). In the preferred embodiment, 9⅝ inch riser (not shown) will connect from a profile in the interior of the wellhead housing 11 to a vessel at the surface. Then 7 inch diameter casing 40 is lowered through the riser (not shown). During this process, the upper tieback member 53 will be secured to the lower tieback member 39 at the surface. The threads 47, 55 will be made up. The collet 41 will latch the tieback members 39, 53 to the lockdown member 31.

The 7 inch casing 40 is stabbed into a polished bore receptacle (not shown) at the lower end of the 9⅝ inch casing 23. The casing 40 will be hung off in a conventional manner and cemented in place. There is no seal at the wellhead housing 11 in the annulus between the casing 40 and the casing hanger 23 or lockdown member 31. Casing 40 will be considered a mudline. Production will be through the casing 40.

At a later date, it may be desirable to remove the portion of casing 40 above the upper tieback member 53, such as for repair purposes. If so, a running tool (not shown) is lowered through the casing 40 into engagement with the slots 63 (FIG. 1A). Preferably the running tool is lowered on drill pipe which has left-hand threads. Normally, the left-hand rotation will cause the tieback threads 47 to unscrew from the threads 55. Then the upper portion of the tieback assembly can be pulled to the surface, bringing along with it the landing sleeve 59. A packoff (not shown) can then be installed in the annulus located between the lower tieback member 39 and the bore of the lockdown member 31 immediately above the wedge member 43.

Figure 2A:
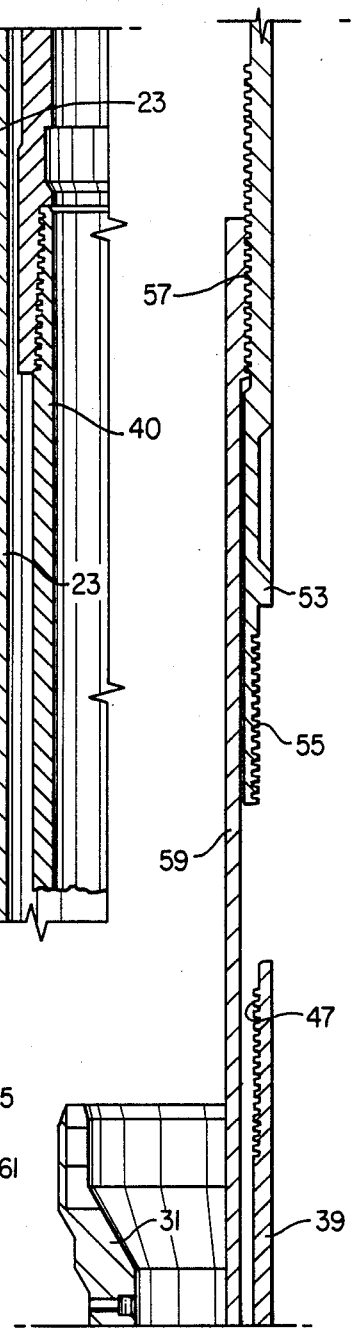
FIGS. 2A and 2B are quarter sectional views of portions of the tieback connector of FIGS. 1A–1C, showing the upper tieback member being lowered into place.
Figure 2B:
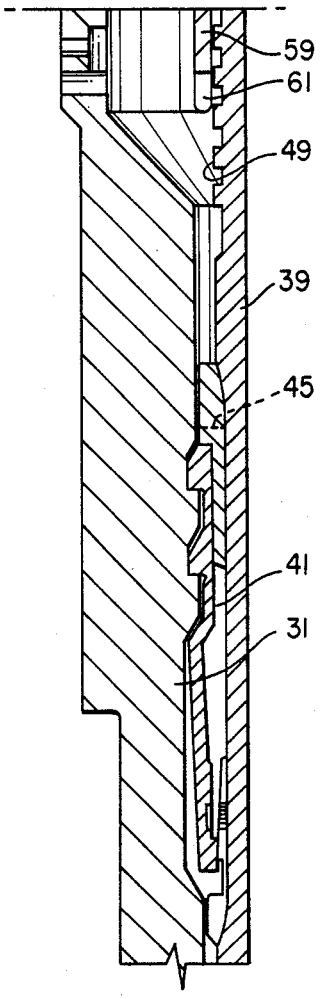
Figure 3A:
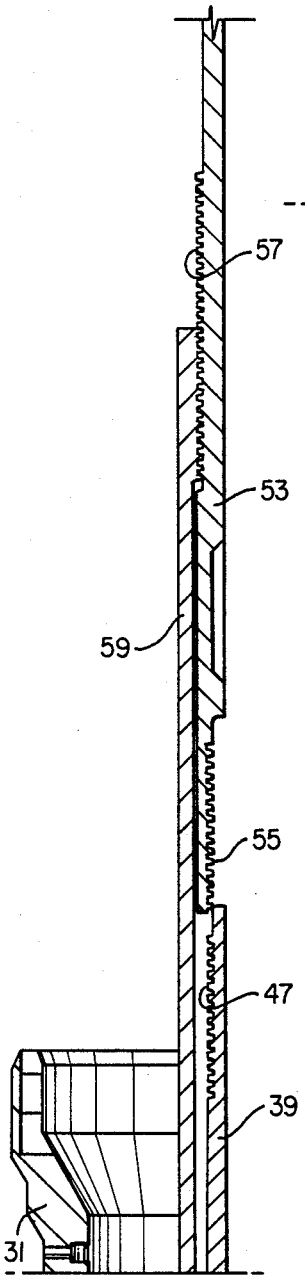
FIGS. 3A and 3B are quarter sectional views of portions of the tieback connector of FIGS. 1A–1C, showing the upper tieback member in contact with the landing shoulder of the lower tieback member and prior to the tieback threads engaging each other.
Figure 3B:
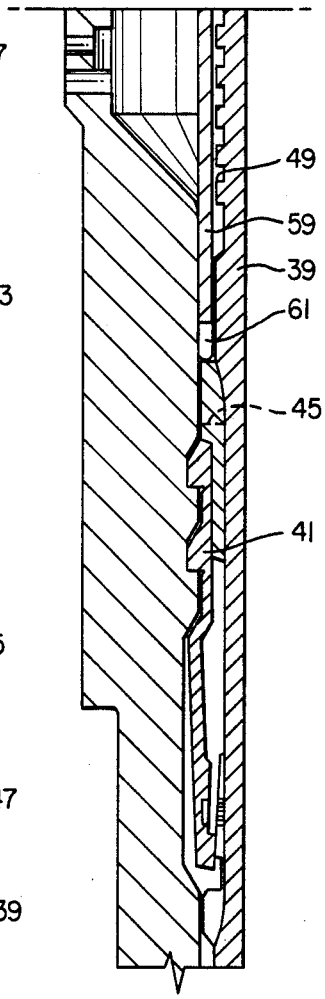

When reconnecting, this packoff will be removed by a retrieving tool (not shown). Then, the casing string 40 is again lowered with the upper tieback member 53. The landing sleeve 59 will be carried in its lower extended position, as shown in FIG. 2A. FIGS. 2A and 2B show the landing sleeve 59 and the upper tieback member 53 immediately prior to the castellated shoulder 61 contacting the castellated shoulder 45. FIGS. 3A and 3B show the castellated shoulders 45, 61 in contact with each other.

When this occurs, the operator rotates the string of casing to the left slightly until the castellations 45, 61 mesh and engage each other. Then, right-hand torque is applied. This causes the upper tieback member 53 to screw downward on the threads 57 relative to the landing sleeve 59. Eventually, the primary tieback threads 47 will engage the primary tieback threads 55 and makeup as shown in FIG. 1A.

Figure 5:
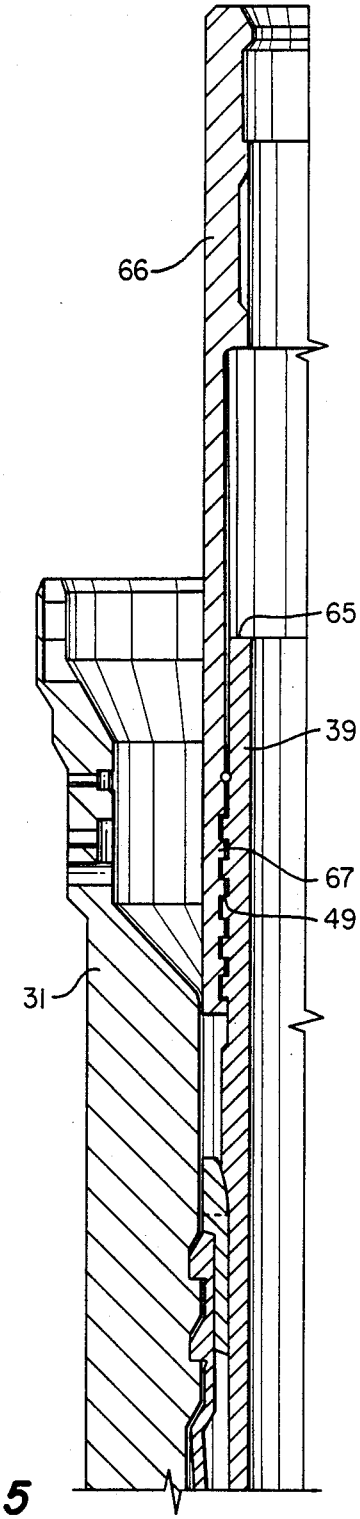
FIG. 5 is a quarter sectional view of a portion of the tieback connector of FIGS. 1A–1C, showing a reconnection after the lower tieback connector has been cut off in an emergency release procedure.

If when attempting to remove the upper tieback member 53, the threads 47, 55 will not break loose, an emergency release procedure exists. The area 51, shown in FIG. 1A, can be cut by a conventional casing cutter (not shown) lowered through the casing 40 on drill pipe. This allows the landing sleeve 59 and upper tieback member 53 to be pulled to the surface. The cut is illustrated by the numeral 65 shown in FIG. 5. Then, when reconnecting, an upper tieback member 66 is lowered on the casing 40. This upper tieback member 66 has threads 67 for engaging the secondary tieback threads 49 which will remain on the lower tieback member 39.

The invention has significant advantages. The assembly can be tested on the surface and run with the 7 inch diameter casing string through 9⅝ inch riser or casing. The lockdown member, which is run after the drilling for the 7 inch casing, provides the profile rather than a casing hanger providing a locking profile. This avoids the need for an extra wear bushing on the casing hanger to protect the landing profile. The landing sleeve protects the primary threads from being bumped when reconnecting. The secondary tieback threads allow reconnection to be made in the event the primary threads are damaged or removed. The emergency release procedure enables the tieback connector to be released by cutting between the primary and secondary threads.

While the invention has been shown in only one of its forms, it should be apparent to those skilled in the art that it is not so limited, but is susceptible to various changes without departing from the scope of the invention. For example, rather than having exterior threads on the lower tieback member, a box with interior threads could be utilized.

We claim:

1. In a subsea well having a string of casing with an upper end located within a subsea wellhead, an improved tieback connector for connecting the casing to a conduit extending from the surface, comprising:

a lower tieback member extending upward from the casing and having a set of lower tieback threads;

an upper tieback member carried by the lower end of the conduit, having a set of upper tieback threads for connection to the lower tieback threads;

a lower landing shoulder located in the wellhead;

a landing sleeve carried by the upper tieback member and having an upper landing shoulder for engaging the lower landing shoulder; and means for moving the upper tieback member from an upper position to a lower position relative to the landing sleeve by rotating the conduit after the upper landing shoulder has engaged the lower landing shoulder, the upper landing shoulder being located so as to contact the lower landing shoulder before the upper tieback threads contact the lower tieback threads when the upper tieback connector is in the upper position, the landing sleeve being located so as to cause the upper tieback threads to engage the lower tieback threads when the upper tieback member is in the lower position.

2. In a subsea well having a string of outer casing supported by a casing hanger in a subsea wellhead, an improved tieback connector for connecting a string of inner casing to a conduit extending from the surface, comprising:

a landing profile carried by the casing hanger;

a lower tieback member secured to the upper end of the inner casing, extending upward from the casing hanger and having a set of lower tieback threads;

means for latching the lower tieback member into the landing profile;

an upper tieback member carried by the lower end of the conduit, having a set of upper tieback threads for connection to the lower tieback threads;

a lower landing shoulder carried by the lower tieback member;

a landing sleeve secured by landing sleeve threads to the upper tieback member and having an upper landing shoulder positioned for landing on the lower landing shoulder;

means on the lower landing shoulder and landing sleeve for preventing rotation of the lower landing shoulder and landing sleeve relative to each other once in engagement with each other; and the landing sleeve threads allowing the upper tieback member to move from an upper position to a lower position relative to the landing sleeve by rotating the conduit while the landing sleeve is in engagement with the lower landing shoulder, the upper tieback threads being spaced above the lower tieback threads while in the upper position to avoid damage to the upper and lower tieback threads, the upper tieback threads contacting the lower tieback threads when moved to the lower position.

3. In a well having a subsea wellhead, an improved tieback connector for connecting a string of casing to a conduit extending from the surface, comprising:

a lower tieback member extending upward from the casing and having a set of lower tieback threads;

an upper tieback member carried by the lower end of the conduit, having a set of upper tieback threads for connection to the lower tieback threads;

a lower landing shoulder located in the wellhead;

an upper landing shoulder carried by the upper tieback member for engagement with the lower landing shoulder, the upper and lower landing shoulders being located so as to engage each other before the upper and lower tieback threads engage each other as the upper tieback member is lowered into the wellhead, to avoid damage to the upper and lower tieback threads; and means for moving the upper tieback member downward relative to the lower landing shoulder by rotating the conduit after the upper and lower landing shoulders have engaged each other, to engage the upper tieback threads with the lower tieback threads.

4. In a subsea well having a string of outer casing supported by a tubular casing hanger in a wellhead housing, an improved tieback connector for connecting a string of inner casing to a conduit extending from the surface, comprising:

a tubular lockdown member having a lower end which seats within the interior of the casing hanger;

locking means for locking the lockdown member to the wellhead housing above the casing hanger;

a grooved profile formed in the interior of the lockdown member;

a lower tieback member connected to an upper end of the inner casing, extending upward from the lockdown member and having a set of lower tieback threads;

means for latching the lower tieback member into the profile;

an upper tieback member carried by the lower end of the conduit, having a set of upper tieback threads for connection to the lower tieback threads;

a lower landing shoulder carried by the lower tieback member;

an upper landing shoulder carried by the upper tieback member for engagement with the lower landing shoulder, the upper and lower landing shoulders being located so as to engage each other before the upper and lower tieback threads engage each other as the upper tieback member is lowered into the wellhead housing, to avoid damage to the upper and lower tieback threads; and means for moving the upper tieback threads downward into engagement with the lower tieback threads by rotating the conduit after the upper and lower landing shoulders have engaged each other.

5. In a well having a subsea wellhead, an improved tieback connector for connecting a string of casing to a conduit extending from the surface, comprising:

a lower tieback member extending upward from the casing and having a set of primary lower tieback threads and a set of secondary lower tieback threads spaced axially from the primary lower tieback threads;

an upper tieback member carried by the lower end of the conduit, having a set of upper tieback threads for connection to the primary lower tieback threads;

a lower landing shoulder located in the wellhead;

an upper landing shoulder carried by the upper tieback member for engagement with the lower landing shoulder, the upper and lower landing shoulders being located so as to engage each other before the upper tieback threads engage the primary lower tieback threads as the upper tieback member is lowered into the wellhead;

means for moving the upper tieback member downward relative to the lower landing shoulder by rotating the conduit after the upper and lower landing shoulders have engaged each other, to cause the upper tieback threads to engage the primary lower tieback threads; and a cutting area located in one of the tieback members between the primary and secondary lower tieback threads, for enabling the upper tieback member to be retrieved to the surface by cutting the cutting area in the event that the upper tieback threads fail to unscrew from the primary lower tieback threads, the secondary lower tieback threads subsequently being engaged by the upper tieback threads on rerunning of the upper tieback member.

6. In a subsea wellhead having a tubular casing hanger located in a wellhead housing for supporting a string of outer casing, an improved tieback connector for connecting a string of inner casing to a conduit extending from the surface, comprising:

a tubular lockdown member having a lower end which seats within the interior of the casing hanger;

locking means for locking the lockdown member to the wellhead housing above the casing hanger;

a grooved profile formed in the interior of the lockdown member;

a lower tieback member connected to the inner casing, extending upward from the lockdown member and having a set of primary lower tieback threads and a set of secondary lower tieback threads spaced axially from the primary lower tieback threads;

means for latching the lower tieback member into the profile;

an upper tieback member carried by the lower end of the conduit, having a set of upper tieback threads for connection to the primary lower tieback threads; and a cutting area located in one of the tieback members between the primary and secondary lower tieback threads, for enabling the upper tieback member to be retrieved to the surface by cutting the cutting area in the event that the upper tieback threads fail to unscrew from the primary lower tieback threads, the secondary lower tieback threads subsequently being engaged by the upper tieback threads on rerunning of the upper tieback member.

7. A method of installing a string of casing in a well of a type having a subsea wellhead, connecting an upper end of the casing to a string of conduit extending from the surface, removing the conduit, and reconnecting the conduit, the method comprising in combination:

connecting a lower tieback member to the string of casing;

connecting an upper &tieback member to the lower end of the conduit;

providing the lower tieback member with a set of lower tieback threads;

providing a lower landing shoulder in the wellhead;

mounting an upper landing shoulder to the upper tieback member for engagement with the lower landing shoulder;

providing the upper tieback member with a set of upper tieback threads and connecting the upper tieback member to the lower tieback member; then lowering the casing and upper and lower tieback members into the well on the conduit; then latching the lower tieback member into the wellhead: then, to remove the conduit, unscrewing the upper tieback member from the lower tieback member at the tieback threads, and pulling the conduit from the well; then, to reconnect the conduit, securing the upper tieback member to the end of the conduit and lowering the upper tieback member into the wellhead until the upper landing shoulder engages the lower landing shoulder; then moving the upper tieback member downward relative to the lower landing shoulder by rotating the conduit, to engage the upper tieback threads with the lower tieback threads.

8. A method of installing a string of casing in a well of a type having a subsea wellhead, connecting an upper end of the casing to a string of conduit extending from the surface, removing the conduit, and reconnecting the conduit, the method comprising in combination:

connecting a lower tieback member to the string of casing;

connecting an upper tieback member to the lower end of the conduit;

providing the lower tieback member with a set of primary lower tieback threads and a set of secondary lower threads;

providing the upper tieback member with a set of upper tieback threads and connecting the upper tieback threads to the primary lower tieback threads;

providing a cutting area located in one of the tieback members between the primary and secondary lower tieback threads;

lowering the casing and upper and lower tieback members into the well on the conduit; then latching the lower tieback member into the wellhead; then, to remove the conduit, unscrewing the upper tieback member from the lower tieback member at the lower primary tieback threads, and pulling the conduit from the well;

cutting the cutting area in the event that the upper tieback threads fail to unscrew from the primary lower tieback threads when it is desired to remove the upper tieback member; then, to reconnect the conduit, pulling the upper tieback member to the surface and leaving the secondary lower tieback threads on the lower tieback member; then lowering another upper tieback member back into the wellhead housing and securing its upper tieback threads to the secondary lower tieback threads.

* * * * *

UNITED STATES PATENT AND TRADEMARK OFFICE

CERTIFICATE OF CORRECTION

PATENT NO. : 4,919,454

DATED : April 24, 1990

INVENTOR(S) : Caulfield, et al

It is certified that error appears in the above-identified patent and that said Letters Patent is hereby corrected as shown below:

Column 7, line 62, "&tieback" should be --tieback--.

Signed and Sealed this

Thirty-first Day of December, 1991

*Attest:*

HARRY F. MANBECK, JR.

*Attesting Officer*

*Commissioner of Patents and Trademarks*